United States Patent [19]

Brothers

[11] 4,025,016

[45] May 24, 1977

[54] LADDER ATTACHMENTS

[76] Inventor: Alvin O. Brothers, 2001 E. Franklin St., Evansville, Ind. 47711

[22] Filed: Feb. 4, 1976

[21] Appl. No.: 655,141

[52] U.S. Cl. ..... 248/210; 24/243 B; 24/243 L

[51] Int. Cl.[2] ..... E06C 7/14; B44D 3/14

[58] Field of Search ..... 248/226 R, 226 A, 226 B, 248/226 C, 226 D, 226 E, 228, 316 A, 210, 211, 238, 311.1; 211/71; 24/243 L, 243 B, 243 G, 243 A, DIG. 22

[56] References Cited

UNITED STATES PATENTS

| | | | |
|---|---|---|---|
| 1,283,160 | 10/1918 | Gross | 248/311.1 X |
| 2,121,317 | 6/1938 | Cohen | 248/226 D X |
| 2,334,856 | 11/1943 | Atkinson | 248/226 D UX |
| 2,430,161 | 11/1947 | Csencsics | 248/226 A |
| 2,622,833 | 12/1952 | Robinson | 248/211 |
| 2,677,545 | 5/1954 | Ross | 248/226 B X |
| 2,954,955 | 10/1960 | Feller | 248/226 B |
| 3,125,317 | 3/1964 | Law | 248/210 |
| 3,353,778 | 11/1967 | Sylvain | 248/211 |
| 3,469,810 | 9/1969 | Dorris | 248/228 |

*Primary Examiner*—J. Franklin Foss
*Attorney, Agent, or Firm*—Jenkins, Hanley & Coffey

[57] ABSTRACT

Ladder attachments including holding assemblies designed to be fastened in various orientations on several different types of ladders. The attachments require no modification of the ladders. Each attachment comprises a clamp block having an alignment portion including an alignment surface for aligning the block against a ladder leg, a clamping portion and a web portion which joins the clamping and alignment portions. A second clamp portion is attached to the block by a bolt. The clamp block and second clamp portion are disposed on the bolt intermediate its ends and are adjustable relative to one another to clamp a ladder leg. The holding member is attached to one of the bolt ends and is proportioned and designed to hold an article outwardly from the ladder leg. In one embodiment, the holding member and second clamp portion are combined to create an easel tool which, when used in pairs, converts a ladder into an easel. The holding member may also be a pot hook which receives the bail of a paint pail to hold the pail outwardly from the side of a ladder leg.

1 Claim, 19 Drawing Figures

LADDER ATTACHMENTS

This invention relates to assemblies for situating paint containers and articles to be painted at selected positions on various types of ladders.

Painters often use ladders to provide easy access to areas which they are painting. A painter may have several different types of ladders which he regularly uses. For example, in certain situations it may be easier to use a step ladder, while in other situations it may be necessary to use an extension ladder or other type of ladder. No matter what type of ladder a painter is using, he frequently must be able to situate a paint container so that it may be easily reached while he is on the ladder. For such needs, various types of container holding apparatus have been devised. See, for example, my copending U.S. patent application Ser. No. 606,514, filed Aug. 21, 1975 and titled "Container Holding Arrangement".

It is advantageous for a painter not to have to carry to a job several different types of container holding apparatus, one for each different type of ladder that he may use. Similarly, it is advantageous for a painter not to have to modify each of his ladders to be able to accept some sort of universal container holding apparatus.

In addition to ladders, painters frequently need other types of apparatus against which they can place articles upon which they are working. Easels frequently satisfy these needs. However, a painter may encounter situations in which an easel would be advantageous, but none is available.

Prior art container holding apparatus cannot readily be adapted so that a ladder may be used as an easel. Such a feature may be particularly advantageous to the commercial painter whose equipment is required to be adaptable to the various situations which he encounters.

Accordingly, it is an object of the present invention to provide an attachment for a ladder which may be used to convert the ladder to an easel.

It is a further object of the present invention to provide an apparatus for securely clamping to various different types of ladders, the apparatus supporting a member for holding a paint bucket or other container.

Additionally, it is the object of the present invention to provide a painter's tool in which portions of the easel assembly and container holding assembly are interchangeable.

A further object of the present invention is to provide a ladder attachment including a clamp block, a second clamp portion and threaded attachment means. The clamp block includes a web portion and alignment and clamping portions. Each of the alignment and clamping portions has a proximal and a distal end. The distal ends of the two are joined together by the web portion. The proximal end of the clamp portion provides a first clamping surface. The proximal end of the alignment portion provides an alignment surface for aligning the clamp block against a ladder leg. The threaded attachment means couples the clamp block to the second clamp portion so that the first clamping surface and second clamp portion can be adjustably drawn tightly against opposite surfaces of the ladder leg.

A notch is defined on the clamp block by the web, the alignment portion and the clamping portion. The notch opens toward the ladder leg, allowing the attachment to be used with a variety of different types of ladders. A holding member is supported by the attachment.

In one embodiment of the present invention, the holding member is a hook proportioned and designed to receive the bail of a bucket. In another embodiment, the holding member comprises a horizontally extending member with a plurality of vertically extending members attached thereto in spaced apart relation to receive and grip securely the bucket.

Further, it is an object of the present invention to provide such a ladder attachment wherein the second clamp portion comprises a strip having forward and rearward ends with one of the adjustable clamp blocks attached to the strip near each of the ends, the strip being sufficiently long to span the width of a leg of the ladder.

Additionally, it is an object of the present invention to provide such a ladder attachment wherein the portion of said strip between the forward one of the said clamp blocks and the forward end of said strip provides a portion which, when used in conjunction with another similar ladder attachment, converts the ladder into an easel.

Additional objects of the present invention will become obvious to those of ordinary skill in the art to which the invention pertains by referring to the following description and accompanying drawings of which:

Figure 1:
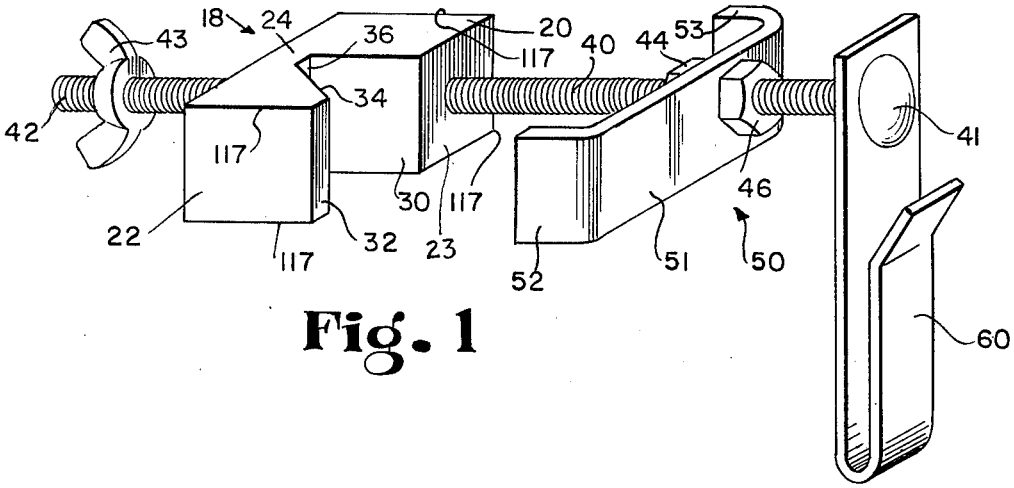
FIG. 1 is a perspective view of a ladder attachment constructed in accordance with the present invention.
Figure 2:
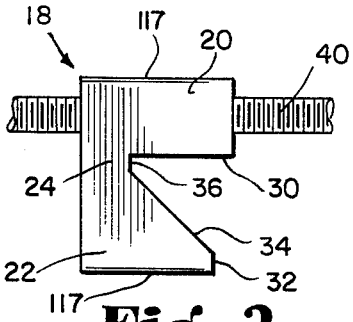
FIG. 2 is a fragmentary top plan view of the attachment of FIG. 1.
Figure 3A:
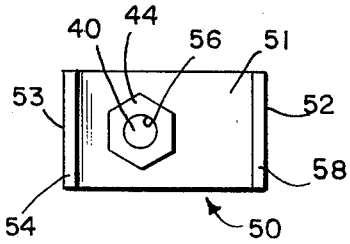
Figure 3B:
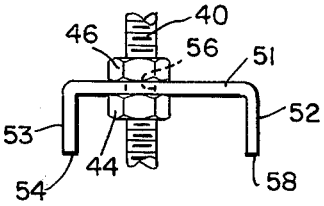
Figure 4A:
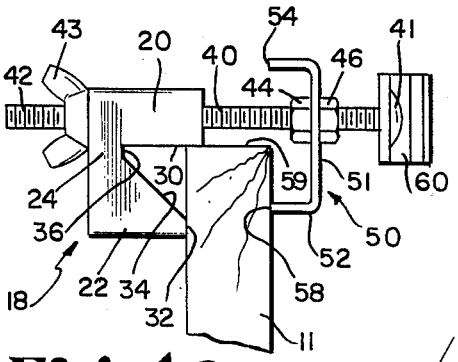
Figure 4B:
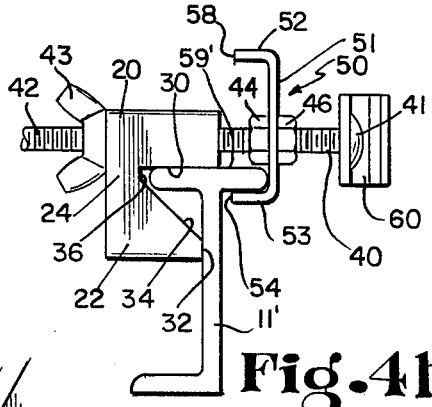
Figure 5:
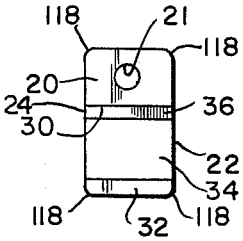
Figure 6:
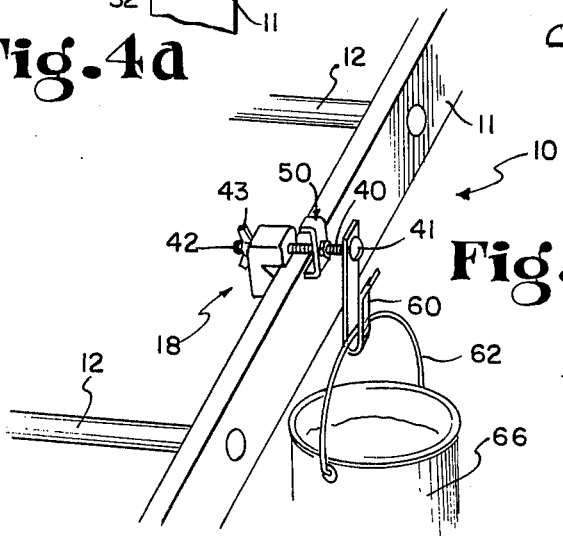
Figure 14A:
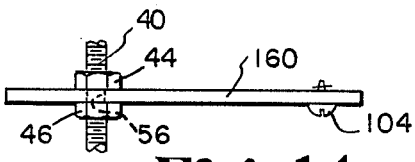
Figure 14B:
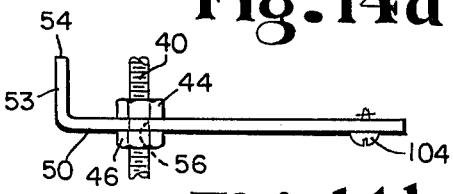
Figure 7:
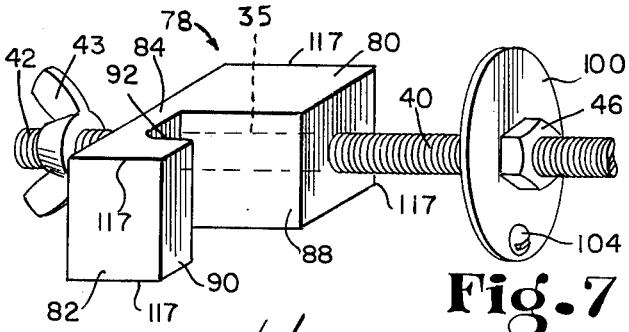
Figure 8:
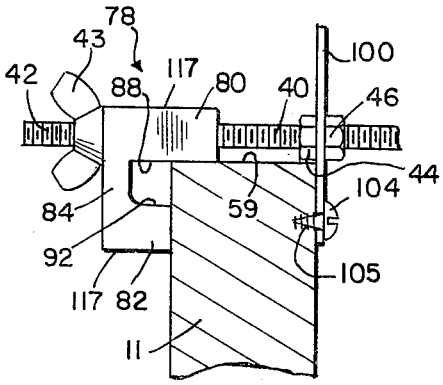
Figure 9:
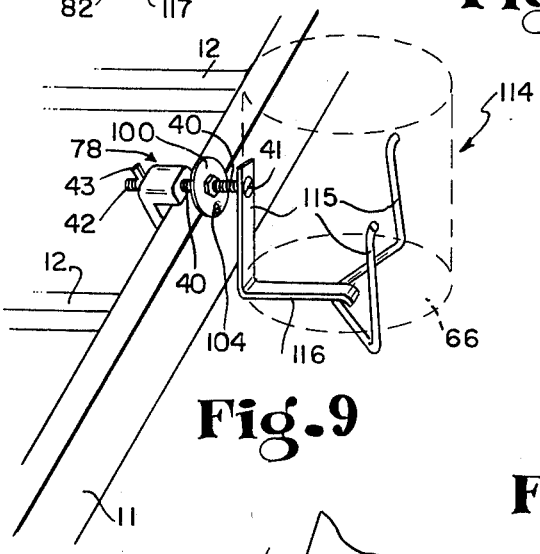
Figure 10A:
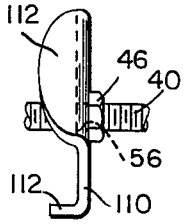
Figure 10B:
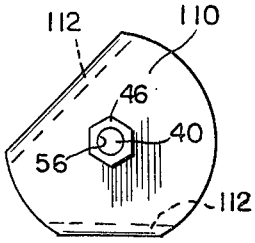
Figure 11:
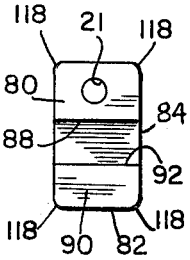
Figure 12A:
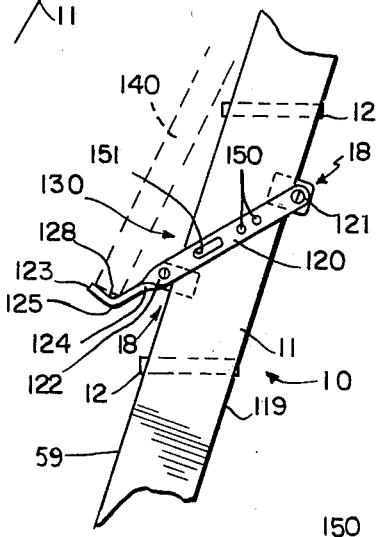
Figure 12B:
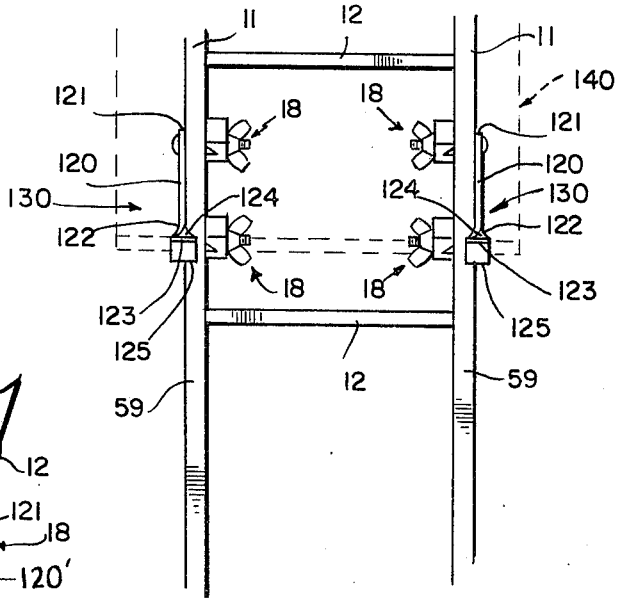
Figure 13:
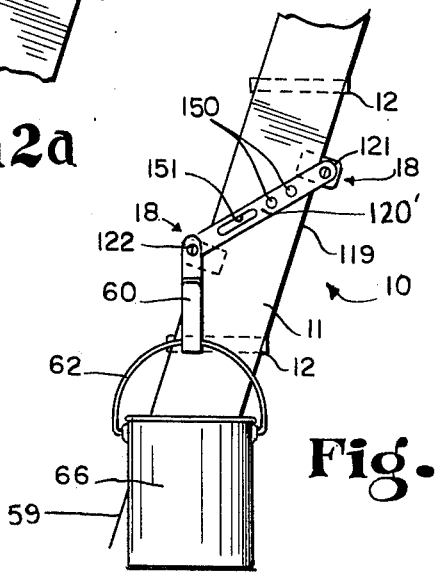

FIGS. 3*a–b* are fragmentary rear elevational and top plan views, respectively, of a portion of the attachment of FIGS. 1-2;

FIGS. 4*a–b* are top plan views of two ladder attachments constructed in accordance with the present invention;

FIG. 5 is a front elevational view of an alternative embodiment of a portion of a ladder attachment of FIG. 1;

FIG. 6 is a perspective view of the attachment of FIG. 1 attached to a ladder (shown fragmentarily), the attachment holding a pail;

FIG. 7 is a fragmentary perspective view of another embodiment of the present invention;

FIG. 8 is a fragmentary top plan view of the attachment of FIG. 7;

FIG. 9 is a perspective view of the device of FIGS. 7–8 attached to a ladder (shown fragmentarily);

FIG. 10*a–b* are fragmentary side and front elevational views, respectively, of portions of the attachment of FIGS. 7–9;

FIG. 11 is a front elevational view of an alternative embodiment of a portion of the attachment of FIGS. 7–9;

FIGS. 12*a–b* are fragmentary side and front elevational views, respectively, of an embodiment of the present invention applied to a ladder;

FIG. 13 is a fragmentary side elevational view of an embodiment of the present invention applied to a ladder; and FIGS. 14*a–b* are fragmentary top plan views of alternative embodiments of the portion of the attachment illustrated in FIGS. 3*a–b*.

In FIG. 1, the device of the present invention includes a clamp block 18 having an alignment portion 20 and a clamping portion 22, having forward or proximal ends 23, 32, respectively. The distal or rearward ends of portions 20, 22 are joined by a web of material 24. As illustrated, a V-shaped notch is desirably formed by the inwardly facing walls 30, 36, 34 of portions 20, 24, 22, respectively. Surface 30 forms an alignment surface for the clamp block and surface 32 forms a first clamping surface thereof. The alignment surface provides a ready means for aligning the clamp block properly against an edge of a ladder leg. The first clamping surface is one of two elements between which the ladder leg will be clamped as will be discussed in greater detail hereinafter.

An illustrative adjustment and attachment means 40 is a threaded bolt having a head 41 and a distal or rearward end 42 with a wing nut 43 threaded thereon. Bolt 40 readily passes through a hole 35 in clamp block 18. The axis of hole 35 is generally parallel to surface 30. A pair of positioning nuts 44, 46 are threaded on bolt 40 intermediate ends 41, 42 with a generally C-shaped second clamp portion or bracket 50 captured therebetween.

Bracket 50 has a straight back 51 and two straight side portions 52, 53 terminating in surfaces 54, 58, respectively. As best illustrated in FIGS. *3a–b*, *4a–b*, a hole 56 is placed somewhat off-center in back 51 so that bolt 40 may pass through the back. The off-center location of hole 56 allows bracket 50 to be used in two configurations as shown in FIGS. *4a–b*.

First, as shown in FIG. *4a*, side portion 52 with clamping surface 58 may be used to clamp the ladder attachment well back from the forward edge 59 of the ladder leg 11 having a generally rectangular transverse section. As shown in FIG. *4b*, side portion 53 may be used to clamp the ladder attachment substantially closer to the forward edge 59' of an extruded metal ladder leg 11' having a generally I-shaped transverse section. Side portion 53 engages leg 11' directly behind the extruded flange which forms the forward edge 59' of ladder leg 11', thereby securely fastening the attachment to the ladder leg. If the flange on the forward edge 59' of the extruded ladder leg is too deep to allow side portion 53 to engage it, side portion 52 can, of course, be used on the extruded leg.

A variety of holding assemblies may be attached to the head 41 end of bolt 40. The assemblies may be adapted to receive paint buckets or other implements commonly used by a painter. As one example, FIGS. 1, 6 show a pothook 60 pivotally attached to the forward or head end 41 of bolt 40. With the ladder attachment clamped to the leg 11 of the ladder 10 as shown in FIG. 6, pothook 60 receives the bail 62 of a conventional paint bucket 66, thereby securing the paint bucket on the outside of leg 11. The pivotal attachment of the pothook allows the attachment to be used on either leg of the ladder.

Other embodiments of the adjustable clamp block and second clamp portion are illustrated in FIGS. 7–10*a–b*. In the embodiment of the clamp block illustrated in FIGS. 7, 8 the clamp block 78 has an alignment surface 88. The clamping portion 82 has a first clamping surface 90 and an inside surface 92 which faces alignment surface 88. A web portion 84 joins alignment portion 80 and clamping portion 82, forming internally of the clamp block 78 a generally rectangular or C-shaped notch. The V-shaped notch of the embodiment of FIGS. 1–6 is well suited to be used with either ladders having rectangular cross section legs or extruded legs with flanged edges as shown in FIGS. *4a*, *4b*, respectively. However, the V-shaped notch is ideally suited for use with extruded legs such as leg 11' of FIG. *4b*. Similarly, although the rectangular cross section notch of clamp block 78 may be used with either type of ladder leg, it is better suited to be used with legs having rectangular cross sections as shown in FIG. 8.

The second clamp portion in the embodiment of FIG. *7a* comprises a thin, flat metal disc 100 with a central circular aperture 56 therethrough. The disc is retained on bolt 40 between nuts 44, 46. In the periphery of disc 100, a small screw 104 protrudes from the rearward face 105 toward first clamping surface 90 of adjustable clamp block 78. Screw 104 penetrates into the surface of a ladder leg 11, which ladder leg has a generally rectangular transverse section, as illustrated in FIG. 8. Clamp portion 100 with penetrating member 104 is particularly suited to ladders having wooden legs.

Another embodiment of the second clamp portion which is useful on ladders having either wooden or extruded metal legs is illustrated in FIGS. 10*a–b*. In this embodiment, a flat metal disc 110 is bent along two chords thereof to form two rearwardly projecting "ear" portions 112. Ears 112 in the embodiment of FIGS. 10*a–b* allow disc 110 to be used on either the left or right side of a ladder leg. Ears 112 serve the same purpose as screw 104 of disc 100 in the embodiment of FIGS. *7a*, i.e., more securely to clamp the ladder attachment to the leg of the ladder. In addition, the ear 112 of the embodiment of FIGS. 10*a–b* and the screw 104 of the embodiment of FIGS. 7–9 may be inserted behind the forward edge flange of an extruded metal ladder leg as was the second clamp portion 50 of FIG. *4b* more securely to clamp the attachment to such an extruded ladder leg.

The attachment of FIG. 7–8 is shown in FIG. 9 with a container receiving assembly 114 connected to the forward or head end 41 of bolt 40. The assembly 114 comprises a plurality of vertically extending arms 115 connected to one another by a horizontally extending member 116. One of arms 115 has an aperture near the top thereof, which aperture receives bolt 40. Details of the structure of assembly 114 are described in my aforementioned co-pending U.S. patent application Ser. No. 606,514. A paint bucket 66 is securely received among vertical members 115 to hold bucket 66 outwardly from leg 11 of ladder 10.

Adjustable clamp blocks 18, 78 already described have had generally square longitudinally extending edges 117. Of course, these edges need not necessarily be square. It may be advantageous in certain circumstances to manufacture the clamp blocks 18, 78 with rounded longitudinally extending edges 118 as illustrated in FIGS. 5, 11. It will also be appreciated that the clamping blocks may be formed by techniques other than machining, extruding, molding or casting as the drawings suggest. For example, the blocks may be formed from sheet metal strips bent to provide the portions and surfaces described.

As was previously mentioned, in many situations a workman may find it advantageous to have a tool which he may use to convert a ladder into an easel. Accordingly, the device of FIGS. 12*a–b* comprises two clamp blocks 18, one clamped to each of the front edge 59 and rear edge 119 of ladder leg 11. The two blocks are clamped to the ladder and to one another by a second clamp portion comprising a metal strip 120 with one of clamp blocks 18 attached to the rearward end 121 thereof, and another clamp block 18 attached near the forward end thereof at point 122. Of course, clamp blocks 78 could also be used. Between point 122 and its forward end 123, strip 120 is twisted 90° as shown at point 124 and is then bent at 125 to form a ledge 128. One of the easel tools 130 thus formed may be attached to each of two legs 11 of the ladder 10 as shown in FIG. 12*b* to convert the ladder into an easel. A sign board, or other item, shown in dashed lines as element 140, may then be rested upon surfaces 128 of easel tools 130 so that the workman may work comfortably on item 140 without having to use an easel. It should be noted that a pothook such as pothook 60 of FIGS. 1 and 6 may be incorporated into the tool of FIGS. 12*a–b* by placing the hook outwardly of strip 120 from one of the bolts at 121, 122.

FIG. 13 illustrates another arrangement which utilizes two clamp blocks 18 and a second clamp portion 120' similar to the ones illustrated in FIGS. 12*a–b*. As in FIGS. 12*a–b*, the blocks 18 are attached to the opposite ends 121, 122 of a strip of material 120'. One of blocks 18 is clamped to the front edge 59 of ladder leg 11 while the other block 18 is clamped to the rearward edge 119 of the leg. A pothook 60 is attached to the bolt 40 of the forward clamp block. A paint bucket 66 may be suspended by its bail 62 from pothook 60. An advantage of the use of a strip 120' is that use of two clamp blocks 18, one on forward edge 59 and one on rearward edge 119, further insures that the paint bucket will be securely held in position on the ladder 10.

Clamp blocks 18, 78 have several advantages when used in conjunction with the second clamp portions 50, 100, 110 or similar members. First, these blocks securely attach holding assemblies, such as pothook 60 or container receiving assembly 114 to a ladder leg. Such attachments are secure regardless of the configuration of the ladder leg cross section. They can be used with ladder legs having rectangular cross sections or flanges. Since the inventive attachments clamp an edge of the ladder, their usefulness is not limited to ladder legs having a particular width from one edge to the other.

These attachments can be used on either extension ladders or step ladders. The attachments can be loosened easily by turning wing nuts 43 so that the attachments can be repositioned by sliding them upwardly or downwardly along the edge of the ladder leg. The attachments can be removed without disassembly from the ladder leg by loosening nuts 43 and tilting second clamp members 50, 100, 110 away from the leg. These attachments will accommodate many different types of holding apparatus of which pothook 60, container holding apparatus 114 and easel tool 120 are illustrative.

There are added advantages of the use of second clamp portions, such as strips 120, 120', which extend across the ladder leg. First, two clamp blocks such as blocks 18, 78 are used with each, thereby providing additional clamping of the ladder leg. Also, downward force at point 122 and forward from the ladder leg due to loads placed there causes the attachments to be held in place more securely because the alignment surfaces of the clamp blocks are urged into more intimate contact with the ladder leg.

To maintain a desired angle between strips 120, 120' and ladder legs 11, additional holes 150 and/or an elongated slot 151 may be included in strips 120, 120'. The rearward assembly 18 may be clamped through one of apertures 140, 141. The strips may thus be used on narrower ladder legs than the legs 11 illustrated in the FIGS.

Bracket 50 could be replaced by a straight, flat piece of stock, such as part 160 illustrated in FIG. 14*a*, without side portions 52, 53. The function of one of side portions 52, 53 could be replaced by a screw such as screw 104. Of course, part 160 would be most useful on wood ladders. Screw 104 could be replaced by a dimple on the surface of either of bracket 50 or part 160 or by a pop rivet which protrudes through either of 50, 160. Alternatively, as illustrated in FIG. 14*b*, one end of bracket 50 could have a screw, dimple or pop rivet for use with wood ladders and the other end could have a side portion such as side portion 53 for use with metal ladders.

What is claimed is:

1. A ladder attachment comprising a clamp block having an alignment portion and a first clamping portion, said alignment portion and first clamping portion each having proximal and distal ends, said proximal end of said alignment portion providing an alignment surface for aligning said clamp block against a surface of said ladder, said proximal end of said first clamping portion providing a first clamping surface extending generally perpendicularly of said alignment surface, said block having a web portion joining said distal ends of said alignment and clamping portions to define a notch bound by said web, said alignment portion and said first clamping portion, a second clamp portion, threaded means for drawing said first clamping portion and second clamp portion into clamping engagement with a leg of said ladder, said threaded means having first and second ends, and a member for holding an article to be supported by said ladder, said holding member being supported by said attachment adjacent the first end of said threaded means and said clamp block being located intermediate the first and second ends of said threaded means, said second clamp portion comprising a bracket including a back portion having two opposite ends, and one side portion extending generally perpendicularly to said back portion from one of said ends toward said clamp block, said threaded means including means for retaining said back portion off-center on said threaded means so that said side portion may be used to clamp said ladder attachment securely to a ladder leg having a flange along an edge thereof, and means for gripping a ladder leg having a generally rectangular transverse cross section, said gripping means protruding from said back portion proximate the remaining one of said ends thereof, said second clamp portion being located between said clamp block and said holding member.

* * * * *